United States Patent [19]

Shigut

[11] 4,380,319

[45] Apr. 19, 1983

[54] LIQUID SPRAY NOZZLE

[75] Inventor: Leo J. Shigut, Torrance, Calif.

[73] Assignee: Edward A. Sokolski, Torrance, Calif. ; a part interest

[21] Appl. No.: 357,786

[22] Filed: Mar. 12, 1982

Related U.S. Application Data

[63] Continuation-in-part of Ser. No. 801,390, Jan. 16, 1978, abandoned, and Ser. No. 172,288, Jul. 25, 1980, abandoned, which is a continuation-in-part of Ser. No. 801,390.

[51] Int. Cl.[3] ..... B05B 1/32

[52] U.S. Cl. ..... 239/540; 239/590.3; 239/DIG. 1

[58] Field of Search ..... 239/451, 538, 540, 579, 239/590.3, 597, 599, 601, DIG. 1

[56] References Cited

U.S. PATENT DOCUMENTS

| | | | |
|---|---|---|---|
| 1,276,245 | 8/1918 | Millard et al. | 239/597 |
| 2,127,883 | 8/1938 | Norton | 239/597 |
| 3,432,105 | 3/1969 | Delamater | 239/540 |
| 3,437,274 | 4/1969 | Apri | 239/599 |
| 3,647,147 | 3/1972 | Cook | 239/599 |

FOREIGN PATENT DOCUMENTS

| | | | |
|---|---|---|---|
| 258501 | 4/1963 | Australia | 239/597 |
| 1178631 | 1/1970 | United Kingdom | 239/597 |

*Primary Examiner*—John J. Love
*Assistant Examiner*—Michael J. Forman
*Attorney, Agent, or Firm*—Edward A. Sokolski

[57] ABSTRACT

A liquid spray nozzle has an outer orificed plate portion with a generally elliptical orifice which tapers in the direction of the water stream and an inner orificed member which has a larger centrally located circular orifice and a pair of smaller circular orifices arranged symmetrically on either side of the central orifice. A centrally located tubular channel member is provided to carry the water stream from a hose or the like such that it passes through the inner and outer orificed members. Means are provided for rotating the orificed members relative to each other. In a first position where the smaller orifices of the inner plate are positioned opposite the corners of the elliptical orifice of the outer plate, a flat, fan-shaped spray is produced. When one of the orificed members is rotated to a position 90° from this first-mentioned position whereat the smaller inner circular orifices are covered by the outer orificed plate, a high-force, narrow cylindrical water stream is provided.

8 Claims, 8 Drawing Figures

LIQUID SPRAY NOZZLE

This application is a continuation-in-part of my application Ser. No. 172,288, filed July 25, 1980, now abandoned and of my application Ser. No. 801,390, filed Jan. 16, 1978, now abandoned of which the first-mentioned application is a continuation-in-part.

This invention relates to liquid spray nozzles, and more particularly to such a device in which the spray can be adjusted to either provide a high pressure, narrow, cylindrical water stream or a flat, fan-shaped spray.

Various types of nozzles for dispensing liquid from a hose have been developed which provide a fan-shaped spray, such as for example those described in U.S. Pat. Nos. 1,362,533 and 1,496,635 to Higley and U.S. Pat. No. 2,130,173 to Barnes. Other devices are commonly available which provide a narrow, high-force cylindrical stream, these nozzles generally employing a narrow circular orifice. Still further, numerous nozzles have been developed wherein the characteristics of the stream can be varied by rotatably moving one orificed member relative to another, the water stream passing through both of these orificed members. Such devices are described, for example, in U.S. Pat. No. 2,380,513 to Garabedian; Canadian Pat. No. 588,626 to Kilian; and German Pat. No. 693,222 to Sprenger.

In my Patent Application No. 172,288 of which the present application is a continuation-in-part, a nozzle is decribed in connection with FIGS. 6–9 thereof which employs a pair of orifice members movable relative to each other for adjusting the water stream between a relatively narrow, high-force pattern to a fan-shaped spray. The device of the present application is an improvement over this nozzle of my prior application in that it has a simplified, more economical construction and is capable of providing a more narrow, high-force water stream in one adjustment position and a flatter, fan-shaped spray in the other adjustable position.

It is therefore an object of this invention to provide an improved hose nozzle of highly reliable and economical fabrication.

It is another object of this invention to provide an improved hose nozzle in which the shape of the spray can be regulated between a narrow, cylindrical high-force stream to a wide fan-shaped spray by means of a rotary adjustment.

Other objects of this invention will become apparent as the description proceeds in connection with the accompanying drawings of which:

Figure 1:
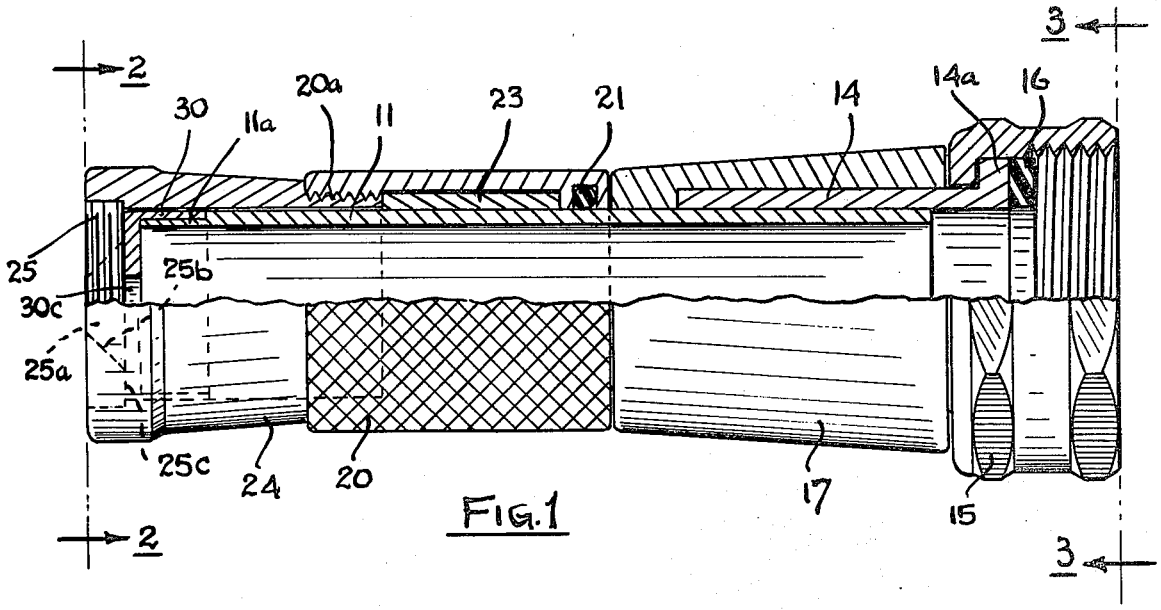
FIG. 1 is a side-elevational view partially in cross section of a preferred embodiment of the invention.

Referring now to the FIGS., a preferred embodiment of the invention is illustrated. The nozzle includes a central tubular member 11 which forms a channel for the water stream. Sweated to one end of channel member 11 is a sleeve member 14 having a flange portion 14*a* at one end thereof. Fitted behind flange member 14*a* is the lip of the cylindrical connector member 15 which is threaded for connection to a hose. A typical O-ring 16 is provided in the connector to provide a water-tight seal to the hose connector. Force-fitted over inner sleeve 14 and fixedly attached thereto is an outer sleeve member 17 which thus is fixedly connected to the tubular channel member 11 while connector 15 is rotatable relative thereto. Rotatably supported on tubular channel member 11 is knurled adjustment ring 20, this ring having an O-ring 21 seated in a groove formed on one end thereof. Adjustment ring 20 is retained in position on channel member 11 by means of a cylindrical retaining ring 23 which is sweated to the outer surface of tubular member 11 after the adjustment ring 20 has been installed in position. Thus, the adjustment ring 20 can be rotated relative to tubular channel member 11, yet is restrained against axial movement relative thereto.

Figure 2:
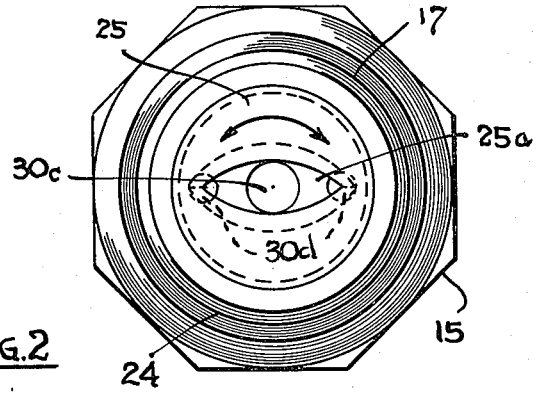
FIG. 2 is a view taken along the plane indicated by 2—2 in FIG. 1.
Figure 3:
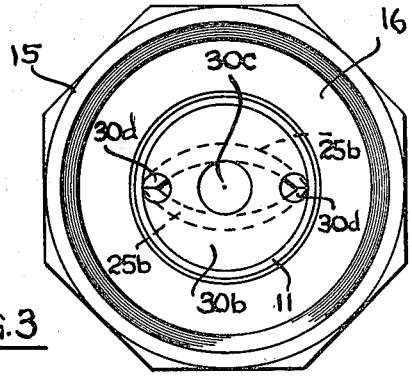
FIG. 3 is a view taken along the plane indicated by 3—3 in FIG. 1.
Figure 4:
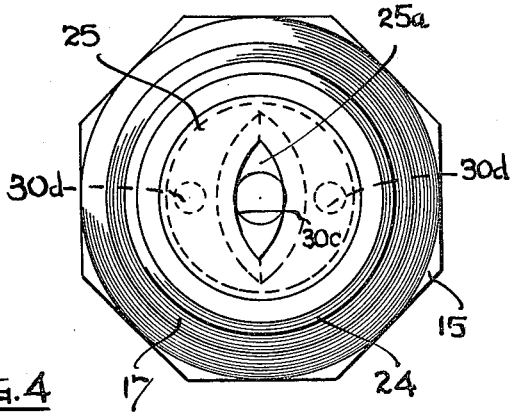
FIG. 4 is a view similar to that of FIG. 2 but showing the nozzle adjusted for a narrow cylindrical high-force water stream.
Figure 5:
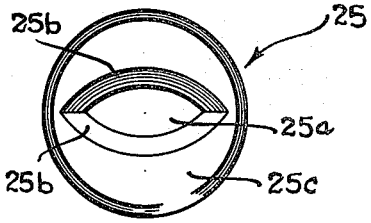
FIG. 5 is a bottom plan view of the outer orificed plate of the preferred embodiment.
Figure 6:
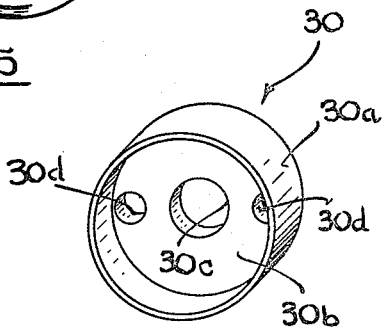
FIG. 6 is a perspective view of the inner orificed cup member of the preferred embodiment.

The outer end portion 20*a* of ring member 20 is threaded and threadably receives cap member 24. Cap member 24 in turn threadably receives outer orificed plate member 25. Plate member 25, as best can be seen in FIG. 5, has a generally biconvex shaped orifice 25*a* formed therein, the edges 25*b* of the orificed portion being tapered or bevelled in the direction of the water stream at a predetermined angle. It has been found that a taper angle of about 45° relative to the inner surface 25*c* of the plate provides optimum results. Fixedly, yet removably, attached to the outer end of tubular channel member 11 is cup member 30 which can best be seen in FIG. 6. The cup member has cylindrical side wall portion 30*a* which fits in snug-tight engagement against undercut end portion 11*a* of the tubular channel member and a flat orificed end wall portion 3*b* which has a larger centrally located orifice 30*c* formed therein and a pair of similar smaller orifices 30*d* formed symmetrically on opposite sides of the central orifice. Orifices 30*d* are located, as can best be seen in FIGS. 3 and 6, so that they are directly opposite the corners of orifice 25*a* when the inner orificed wall 30*b* and the outer orificed plate 25 are relatively positioned as shown in FIGS. 2 and 3. With the outer orificed plate 25 rotated 90° from the position of FIGS. 2 and 3, as shown in FIG. 4, the orifices 30*d* of the inner member are directly adjacent the inner wall 25*c* of the outer orificed plate. As can be seen in FIGS. 2–4, the length of the major axis of the downstream outer edge of the biconvex orifice 25*a* is equal to the distance between the centers of orifices 30*d*, and the length of the minor axis of the downstream outer edge of orifice 25*a* is equal to the diameter of orifice 30*c*.

Figure 7:
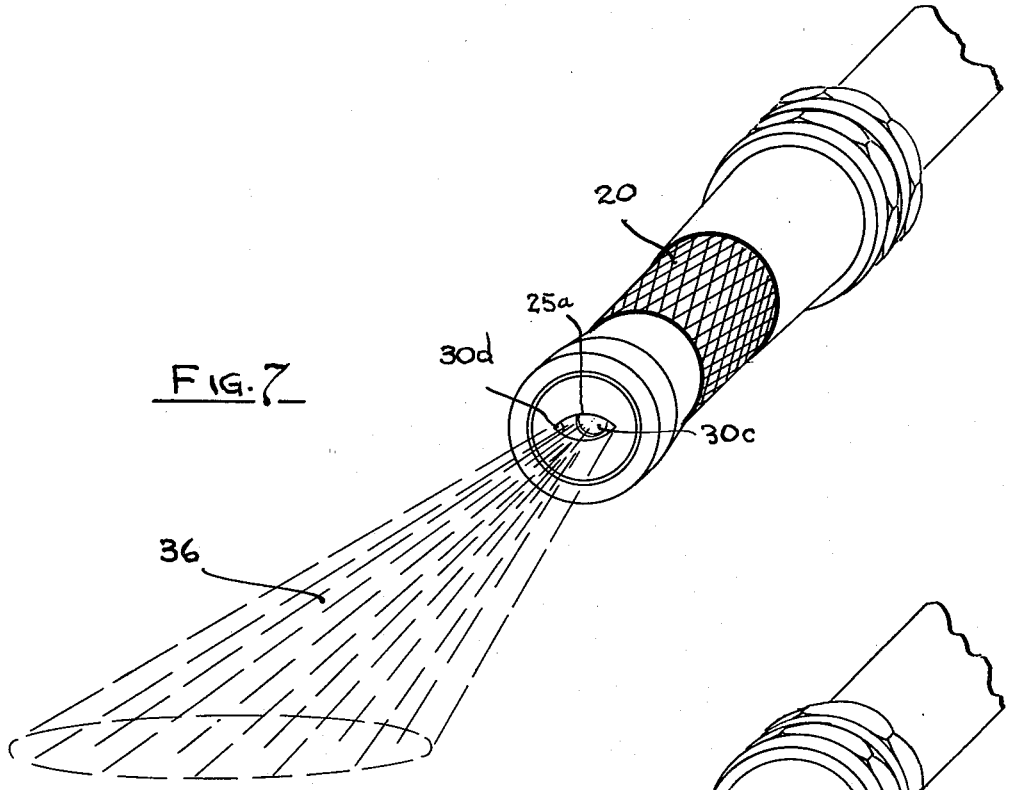
FIG. 7 is a perspective view showing the preferred embodiment adjusted for a fan-shaped spray.
Figure 8:
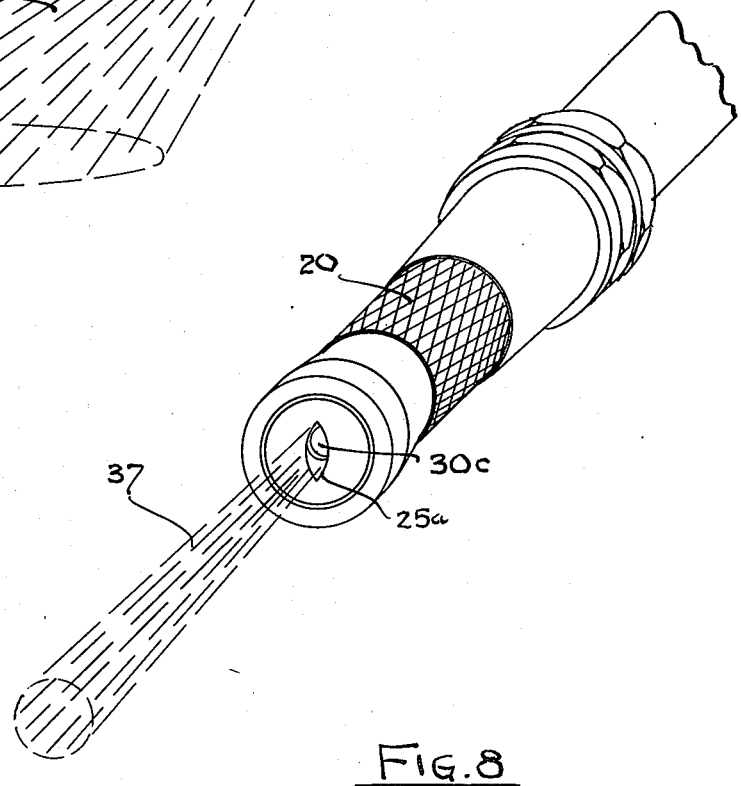
FIG. 8 is a perspective view showing the preferred embodiment adjusted for a cylindrical spray.

Thus, as shown in FIG. 7, when knurled adjustment ring member 20 is rotated relative to tubular channel member 11 (and along with it the cup member 30 attached thereto) to the position shown in FIGS. 2 and 7, a wide flat fan-shaped spray 36 is produced. When the adjustment ring 20 is rotated to ring the outer orificed plate 25 to the position relative to orificed wall 30*b*, shown in FIGS. 4 and 8, a narrow high-force cylindrical stream 37 is produced.

It is to be noted that in the operation of the device the water streams passing through the smaller orifices 30*d* and the larger central orifice 30*c* create a turbulence with the flat fanning effect further being engendered by the tapered walls 25b of the outer orificed plate. On the other hand, with the nozzle adjusted to the position of FIG. 8, the water streams are substantially prevented from passing through orifices 30d in view of the fact in these positions outer plate 25 effectively covers up these orifices.

The device of the present invention thus provides a simple economical yet highly effective hose nozzle which can be adjusted to produce either a narrow cylindrical spray or a flat fan-shaped spray.

While the invention has been illustrated and described in detail, it is clearly to be understood that this is intended by way of illustration and example only and is not to be taken by way of limitation, the spirit and scope of the invention being limited only by the terms of the following claims.

I claim:

1. A nozzle for dispensing liquid comprising tubular channel means for receiving a liquid stream at one end thereof and outletting said liquid stream at the other end thereof, a first inner orificed member having a wall portion which forms a wall for said other end of the tubular channel means, said wall portion having a larger centrally located circular orifice and a pair of smaller circular orifices formed therein, said smaller orifices being symmetrically arranged on opposite sides of the larger orifice, the center of all of said orifices being along a common transverse axis, a second outer orificed plate member having a generally biconvex shaped orifice formed substantially in the center thereof, said biconvex shaped orifice having major and minor axes, the minor axis of said biconvex shaped orifice being equal in length to the diameter of said centrally located circular orifice, the major axis of said biconvex shaped orifice being equal in length to the distance between the centers of said smaller orifices, and means for supporting said second outer orificed member with the biconvex shaped orifice thereof axially aligned with the centrally located orifice of said first inner orificed member, said supporting means for said second outer orifice member being attached to said tubular channel means for rotatable movement between the supporting and tubular channel means, a flat fan-shaped liquid spray being produced when said inner and outer orificed members are relatively positioned in a first position whereat the corners of the elliptically shaped orifice are opposite the smaller orifices, and a narrow cylindrical liquid stream being produced when the inner and outer orificed members are relatively positioned in a second position whereat a non-orificed portion of said outer orificed member is positioned opposite the smaller orifices of the inner orificed member.

2. The nozzle of claim 1 wherein said supporting means for said second outer orificed member comprises an adjustment ring, means for retaining said adjustment ring on said tubular channel means for rotation but substantially restrained from axial movement relative thereto, and a cap member attached to the downstream end of said adjustment ring, said second outer orificed plate member forming a wall for the distal end of said cap member.

3. The nozzle of claim 2 wherein the means for retaining the adjustment ring on the tubular channel means comprises a cylindrical retainer ring sweated to the wall of said tubular channel means.

4. The nozzle of claim 2 wherein said second outer orificed plate member is threadably attached to the cap member.

5. The nozzle of claim 1 wherein said first inner orificed member comprises a cup member having a cylindrical side portion extending normally from the wall portion thereof, the other end of the tubular channel means being undercut, the cylindrical side portion being fitted in snug-tight engagement with said undercut end of the tubular channel means.

6. The nozzle of claim 1 wherein the wall portion of the first inner orificed member is directly adjacent to the outer orificed plate member and in concentric relationship therewith.

7. The nozzle of claim 1 wherein the edges of the orifice of the second outer orificed plate member are tapered in the direction of the water stream, the downstream outer edge of said biconvex shaped orifice defining said major and minor axes.

8. The nozzle of claim 7 wherein said edges are tapered at a substantially 45 degree angle relative to the inner surface of the second outer orificed plate member.

* * * * *